US010912715B2

(12) United States Patent
Aneas

(10) Patent No.: US 10,912,715 B2
(45) Date of Patent: Feb. 9, 2021

(54) DEVICE FOR CONNECTING A VESSEL AND A CONTAINER AND CONNECTION ASSEMBLY INCLUDING SUCH A DEVICE

(71) Applicant: BIOCORP PRODUCTION, Issoire (FR)

(72) Inventor: Antoine Aneas, Menetrol (FR)

(73) Assignee: BIOCORP PRODUCTION, Issoire (FR)

( * ) Notice: Subject to any disclaimer, the term of this patent is extended or adjusted under 35 U.S.C. 154(b) by 277 days.

(21) Appl. No.: 15/779,781

(22) PCT Filed: Nov. 29, 2016

(86) PCT No.: PCT/EP2016/079117
§ 371 (c)(1),
(2) Date: May 29, 2018

(87) PCT Pub. No.: WO2017/093243
PCT Pub. Date: Jun. 8, 2017

(65) Prior Publication Data

US 2019/0175450 A1 Jun. 13, 2019

(30) Foreign Application Priority Data

Nov. 30, 2015 (FR) ..... 15 61578

(51) Int. Cl.
*A61J 1/20* (2006.01)

(52) U.S. Cl.
CPC ..... *A61J 1/2096* (2013.01); *A61J 1/201* (2015.05); *A61J 1/2051* (2015.05); *A61J 1/2055* (2015.05); *A61J 1/2065* (2015.05)

(58) Field of Classification Search
CPC ..... A61J 1/201; A61J 1/2096; A61J 1/2065; A61M 5/3202; A61M 5/3205
See application file for complete search history.

(56) References Cited

U.S. PATENT DOCUMENTS 4,576,211 A 3/1986 Valentini et al.
5,163,918 A 11/1992 Righi et al.
(Continued)

FOREIGN PATENT DOCUMENTS

CN 102046229 A 5/2011
CN 102858394 A 1/2013
(Continued)

OTHER PUBLICATIONS

French Search Report for French Application No. FR 15 51578 dated Aug. 30, 1985.
(Continued)

*Primary Examiner* — Leslie R Deak
(74) *Attorney, Agent, or Firm* — Pearne & Gordon LLP

(57) ABSTRACT

The device allows the connection between a vessel closed off by a perforable stopper and a container. It comprises a base, which is configured to be mounted on the vessel and which comprises a hollow member for perforating the stopper, this hollow member delimiting at least one opening, and a needle holder, which is waiting to be connected with the container, and which includes a needle, one of the ends of which emerges in the inner volume of the hollow member. The device further comprises a collar attached to a needle holder, and a sheath, which is connected around the collar and which defines a central axis along which it is movable against a resilient force exerted by a spring.

15 Claims, 10 Drawing Sheets

(56) References Cited

U.S. PATENT DOCUMENTS

Figure 1:
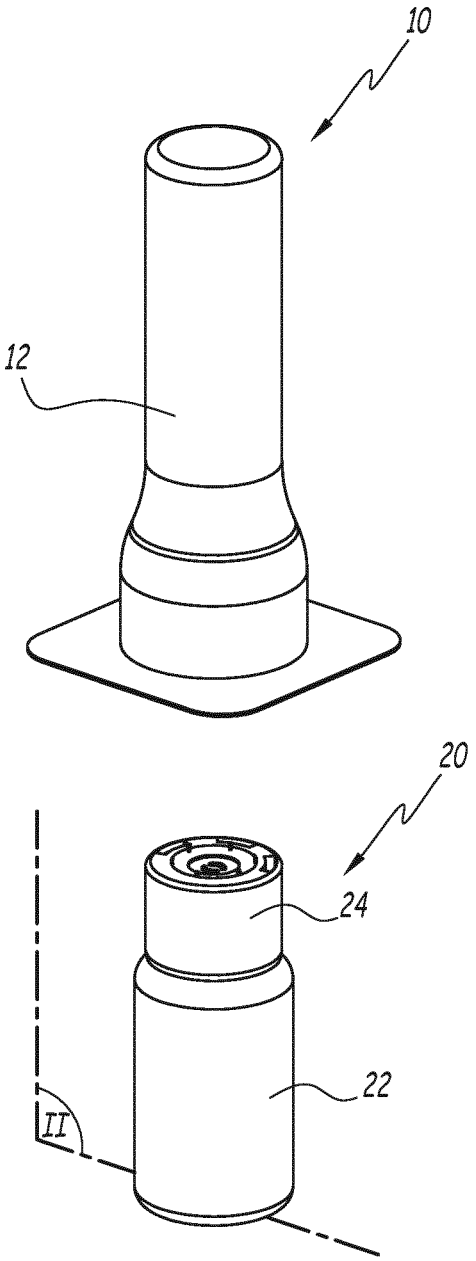

| | | | |
|---|---|---|---|
| 8,985,162 | B2 | 3/2015 | Aneas |
| 9,452,267 | B2 | 9/2016 | Reynolds et al. |
| 9,968,746 | B2 | 5/2018 | Neale |
| 2004/0215147 | A1 | 10/2004 | Wessman et al. |
| 2008/0249479 | A1 | 10/2008 | Zinger et al. |
| 2010/0241088 | A1 | 9/2010 | Ranalletta et al. |
| 2014/0261861 | A1 | 9/2014 | Ivosevic et al. |
| 2014/0261877 | A1 | 9/2014 | Ivosevic et al. |

FOREIGN PATENT DOCUMENTS

| | | | |
|---|---|---|---|
| CN | 103619306 | A | 3/2014 |
| EP | 0467173 | A1 | 1/1992 |
| FR | 2560049 | A1 | 8/1985 |
| RU | 2079308 | C1 | 5/1997 |
| RU | 2009109943 | A | 11/2010 |
| WO | 2012168235 | A1 | 12/2012 |

OTHER PUBLICATIONS

International Search Report for PCT/EP2016/079117 dated Mar. 6, 2017.

International Written Opinion for PCT/EP2016/079117 dated Mar. 6, 2017.

DEVICE FOR CONNECTING A VESSEL AND A CONTAINER AND CONNECTION ASSEMBLY INCLUDING SUCH A DEVICE

This application is a National Stage application of PCT international application PCT/EP2016/079117, filed on Nov. 29, 2016 which claims the priority of French Patent Application No. 15 61578, filed on Nov. 30, 2015, both of which are incorporated herein by reference in their entirety.

The invention relates to a connecting device between a vessel closed by a perforable stopper and a container, a connection assembly comprising the vessel, the container and the device and a method for filling the container using this device.

In particular, the connecting device according to the invention makes it possible, on the one hand, to reconstitute a drug inside a container, such as a syringe body, and on the other hand, to assemble a hypodermic needle on the syringe body, so as to obtain a ready-to-use syringe, i.e., a syringe ready for an injection. The connecting device according to the invention is therefore configured to reconstitute a drug for an injection.

Conversely, US-A-2010/0241088 and US-A-2008/0249479 each disclose a system in which the syringe is a needle-less syringe. Once filled, the syringe is connected to a catheter via a specific adapter. In this system, the connection device therefore does not comprise a needle holder waiting to be connected with the syringe body. This system is therefore not suitable for reconstituting a drug for an injection.

Additionally, US-A-2014/0261877 discloses a very particular system, designed to reconstitute a cancer drug (oncology). This system makes it possible to transfer a liquid, completely sealably and without pressure differential, from a vessel closed off by a perforable stopper toward a syringe. The system includes a connecting device between the vessel and the syringe, which comprises a first adapter on the syringe side, and a second adapter on the vessel side. The second adapter comprises a hollow perforating member of the stopper. The first adapter has a canula holder waiting to be connected with the syringe and having a canula, one end of which emerges in the inner volume of the hollow member (see FIG. 13). The first adapter also has a canula protector, which is provided in the form of a resilient sleeve and which is mounted resiliently around the canula against a resilient force. When the drug is reconstituted, the canula protector is resiliently returned to the sealed covering position of the canula. A separate system is then connected to the syringe to inject the drug into the patient's body. The connecting device therefore does not make it possible to obtain, once the drug is reconstituted, a syringe with a ready-to-use hypodermic needle.

In the field of reconstituting drugs, a device is also known from WO-A-2012/168,235 making it possible to connect a vessel provided with a neck closed off by a perforable stopper with a container intended to be equipped with a needle. Typically, this container is a syringe body. The device comprises a base configured to be mounted on the vessel and comprising a hollow body for perforating the stopper. This hollow member has an opening that places an inner volume of the hollow member in communication with an inner volume of the vessel when the base is mounted on the vessel, i.e., when the stopper is perforated. The connection device also comprises a needle holder, which is waiting to be connected with the syringe body and which is detachable from the base. In particular, the needle holder is provided to be screwed inside a nut mounted on the end part of the syringe body. The needle holder is received inside the base so as to place, through the hollow needle, the inner volume of the hollow member in communication with the inner volume of the syringe body when the needle holder is connected to the syringe body.

The vessel generally contains a drug in orodispensable tablet form, while the syringe body contains a solvent. The drug is obtained by dissolving the orodispensable tablet in the solvent. To prepare an injectable solution using this device, it is necessary to begin by mounting the base on the vessel, so as to perforate the stopper with the perforating member. Next, the needle holder and the syringe body should be sealably connected, and the solvent present in the syringe body should be injected into the vessel. Then, the vessel, the connection device and the syringe body, then assembled, should be arranged in a position where the contents of the vessel flow toward the inner volume of the syringe body. In particular, the contents of the vessel pass through the inner volume of the hollow perforating member and through the central channel of the needle.

Figure 13:
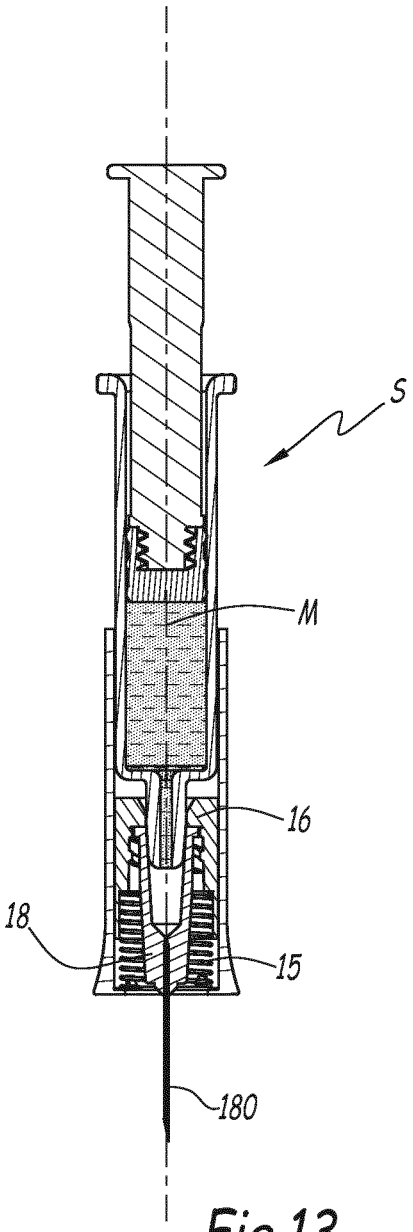

Once the drug is reconstituted, the syringe body and needle holder assembly can then be disconnected from the vessel. This assembly forms a ready-to-use syringe, which is shown in FIG. 13 of WO-A-2012/168,235. As shown in this figure, the hollow needle is exposed, which means that there is a risk of being stuck before and after the injection. There is therefore a risk of disease transmission, such as HIV. The syringe therefore does not comply with the European guidelines and the recommendations by the American Food and Drug Administration (FDA) regarding any device bearing a needle.

The invention more particularly aims to resolve these drawbacks by proposing a connecting device with which the container, then connected to the needle holder, is safer once it is disconnected from the vessel.

To that end, the invention relates to a connecting device between a vessel closed off by a perforable stopper and a container, such as a syringe body, this device comprising:

- a base, which is configured to be mounted on the vessel and which comprises a hollow member for perforating the stopper, this hollow
- a needle holder, which is detachably connected relative to the base, which is waiting to be connected with the container, and which includes a hypodermic needle, one end of which emerges in the inner volume of the hollow member.

According to the invention, the device further comprises:

- a collar attached to the needle holder, and
- a sheath, which is connected to the collar and which defines a central axis along which the sheath is movable relative to the collar and around the latter, against a resilient force exerted by return means.

Owing to the invention, when the container is separated from the vessel, in particular when the drug is reconstituted, the sheath and the return means together form a safety system seeking to protect the needle before and after use. In particular, the sheath tends, under the action of the return means, to occupy a position where it covers the needle, which prevents accidentally being stuck before injection and limits the risk of breaking. During an injection, the sheath withdraws in contact with the skin to expose the needle, which can then penetrate the epidermis to perform the injection. At the end of the injection, the sheath again covers the needle under the effect of the return means and then once again covers the needle, in order to protect the needle after the injection and thereby prevent accidental sticking after the injection.

According to advantageous, but optional aspects of the invention, such a connecting device comprises any one of the following features, considered in any technically allowable combination:

- The return means comprise a spring inserted axially between the collar and an inner radial shoulder of the sheath.
- The collar comprises at least one radial pin, which is engaged in a corresponding radial opening of the sheath.
- Each opening has a first branch and a second branch that each extend from an axial corridor, the first branch, the second branch and the corridor together forming a "Y".
- The device comprises a sealing sleeve, which is traversed by the needle and which is immobilized inside the base so as to provide sealed communication between the inner volume of the hollow member and a central channel of the needle.
- The needle has a beveled end, which has a height greater than or equal to the height of a wall of the sleeve traversed by the needle.

In one configuration where the needle holder is detached from the base, the sheath is movable between a first position where it covers the needle and a second position, where the needle is exposed and the return means are configured to return the sheath to its first position.

- The device comprises means for locking the sheath in the first position, configured to prevent the sheath from returning toward its second position.
- The needle holder is screwed inside the collar.
- Each opening is configured such that, when the sheath is returned to its first position, it pivots around its axis in the screwing direction of the needle holder.
- The sheath cannot be deformed in compression in the direction of the central axis.
- The sheath comprises two opposite orifices along the central axis.
- The needle holder comprises a frustoconical inner surface, to receive an end part of the container and is sized to be fitted forcibly around said end part.

The invention also relates to a connecting assembly, comprising a vessel closed off by a perforable stopper, a container and a connecting device as previously defined.

The invention lastly relates to a method for filling a container intended to be equipped with a needle with a product contained in a vessel closed off by a perforable stopper. According to the invention, this method comprises the following steps:

a) mounting a connecting device as previously defined on the vessel to perforate the stopper with the perforating member, b) connecting the container with the needle holder, c) injecting a liquid present in the container into the vessel, through the central channel of the needle and the inner volume of the perforating member, d) arranging the vessel, the connecting device and the container in a position where the contents of the vessel flow toward the inner volume of the container, through the inner volume of the perforating member and the central channel of the needle, and e) disconnecting the container and the vessel, the needle holder then being removed from the base and the sheath being maintained or returned by the return means into a first position where it covers the needle.

Figure 2:
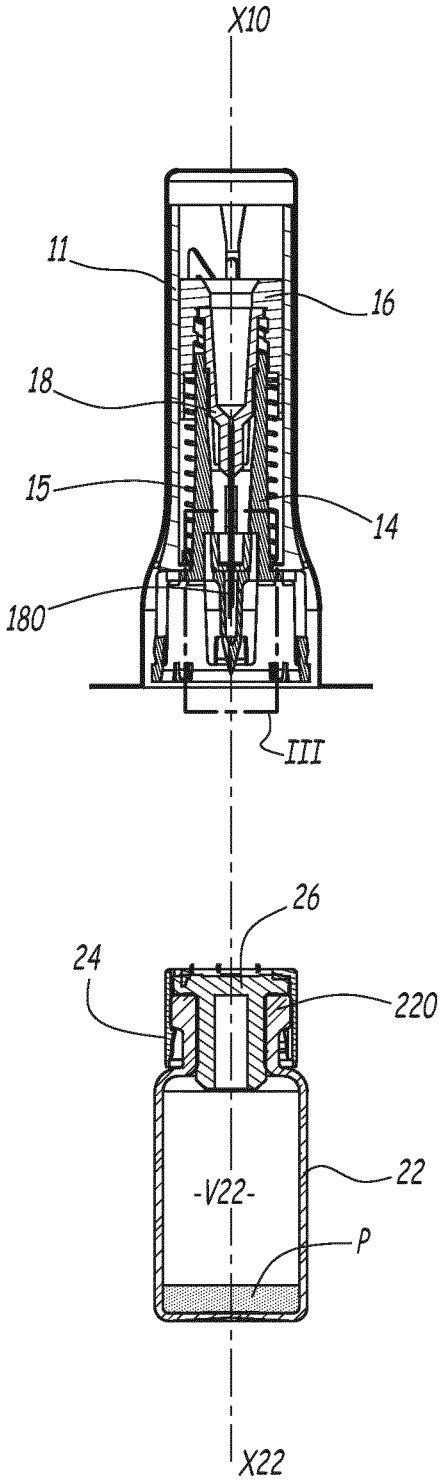
Figure 3:
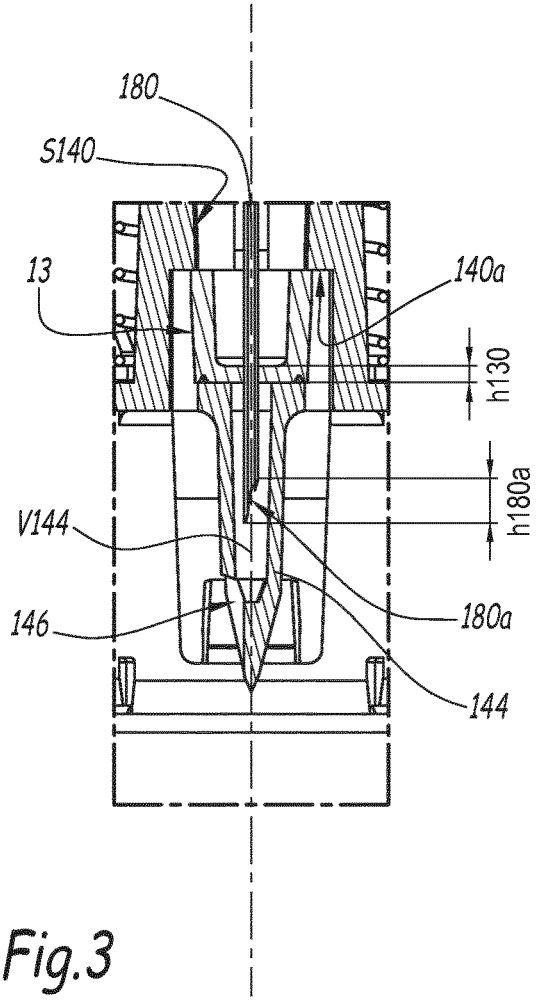
Figure 4:
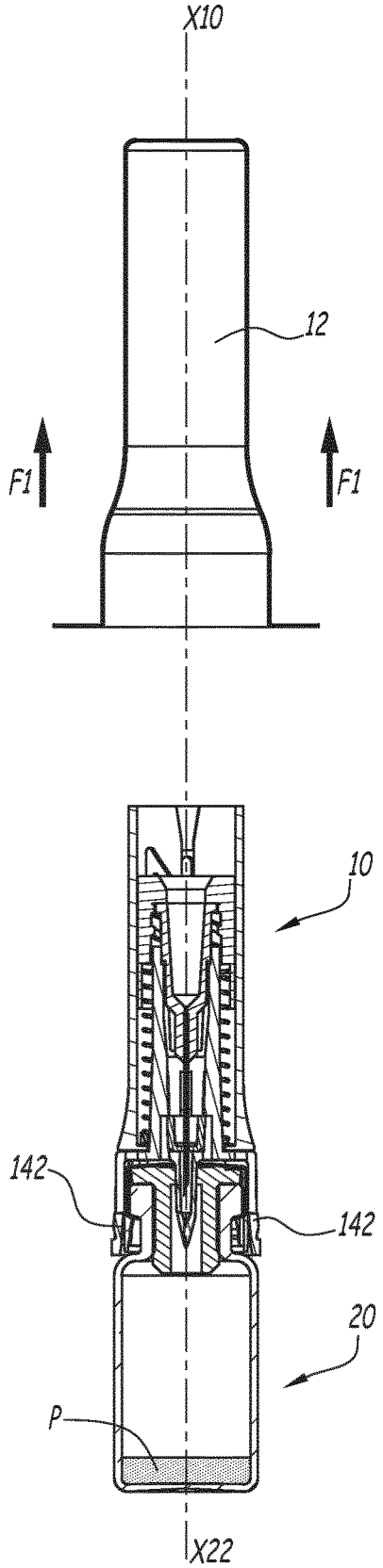
Figure 5:
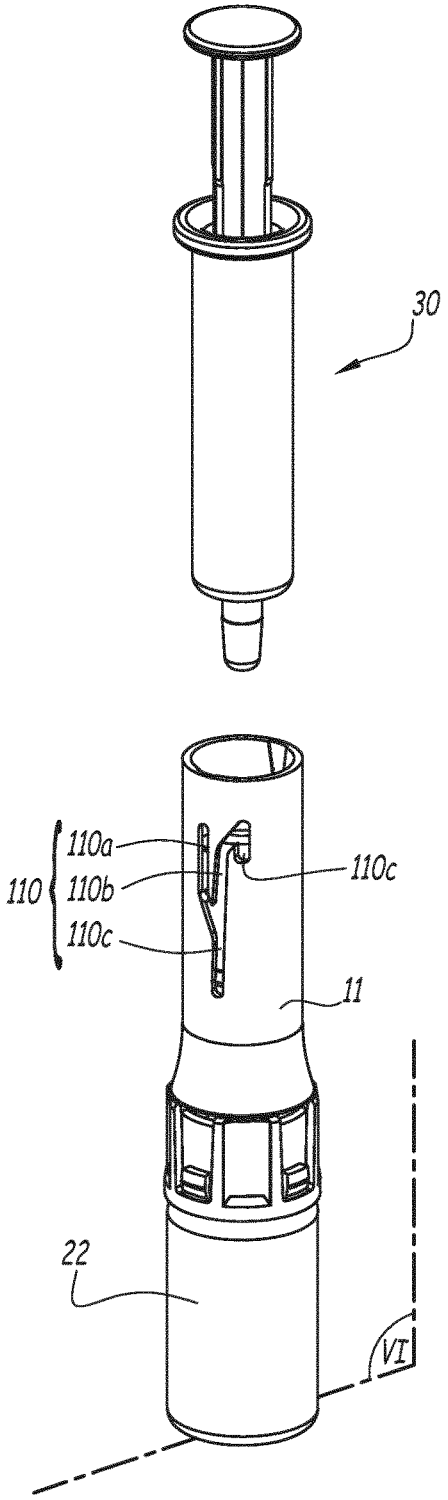
Figure 6:
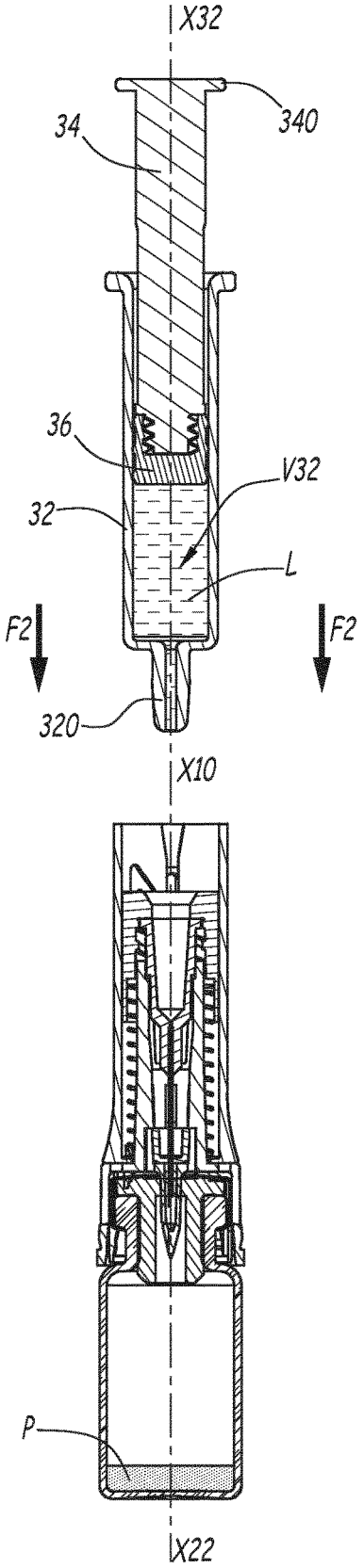
Figure 8:
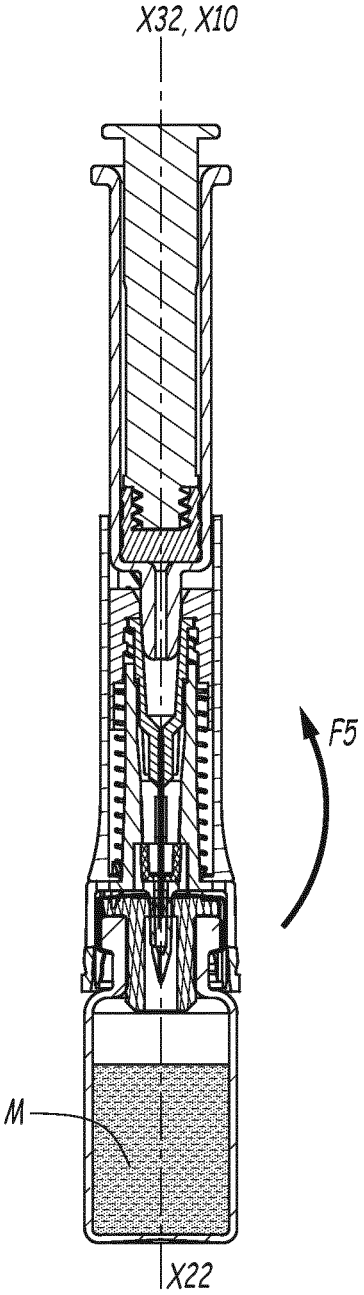
Figure 9:
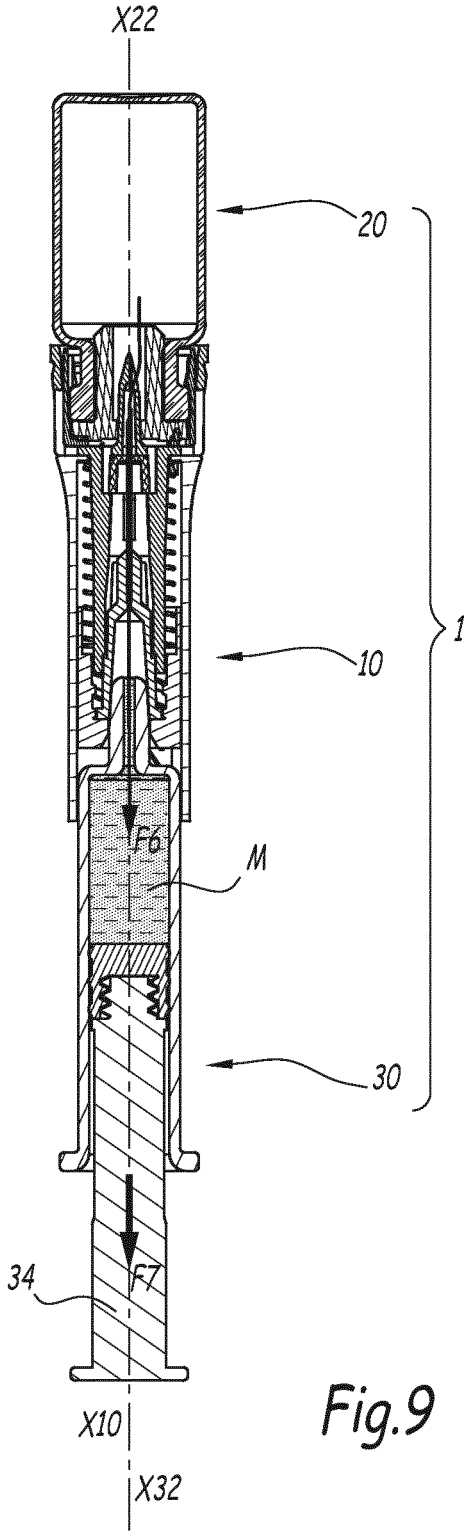
Figure 10:
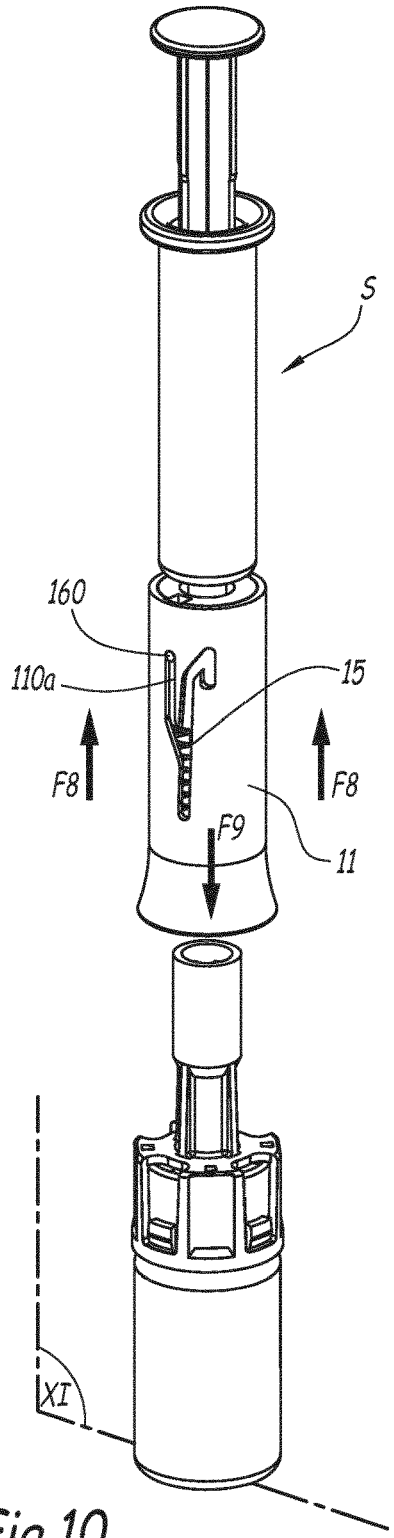
Figure 11:
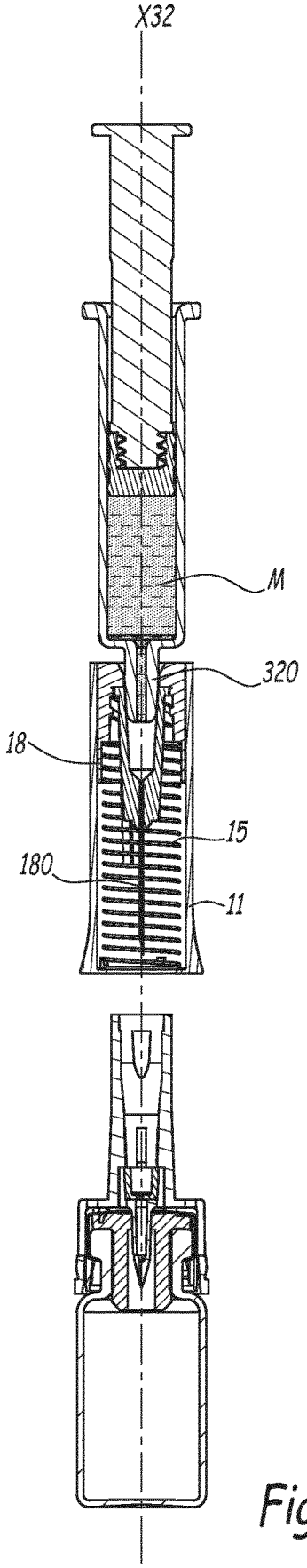
Figure 12:
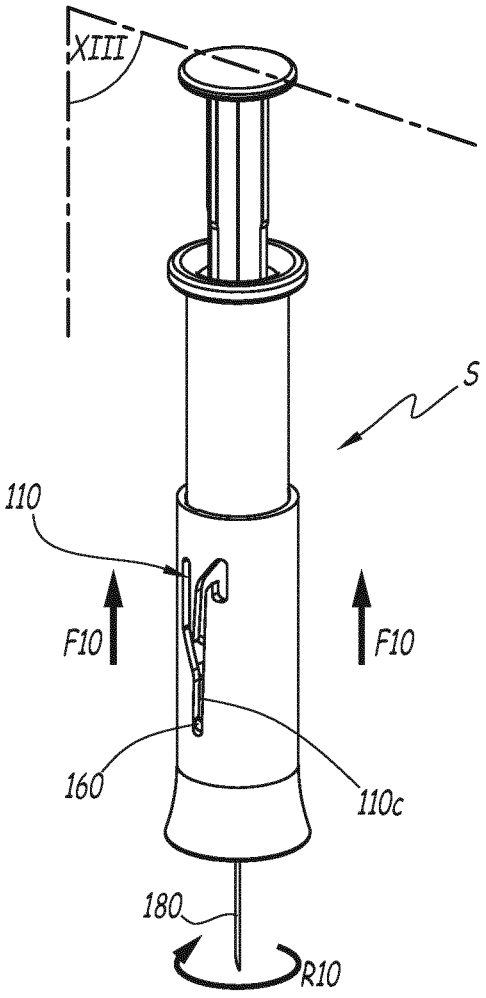
Figure 14:
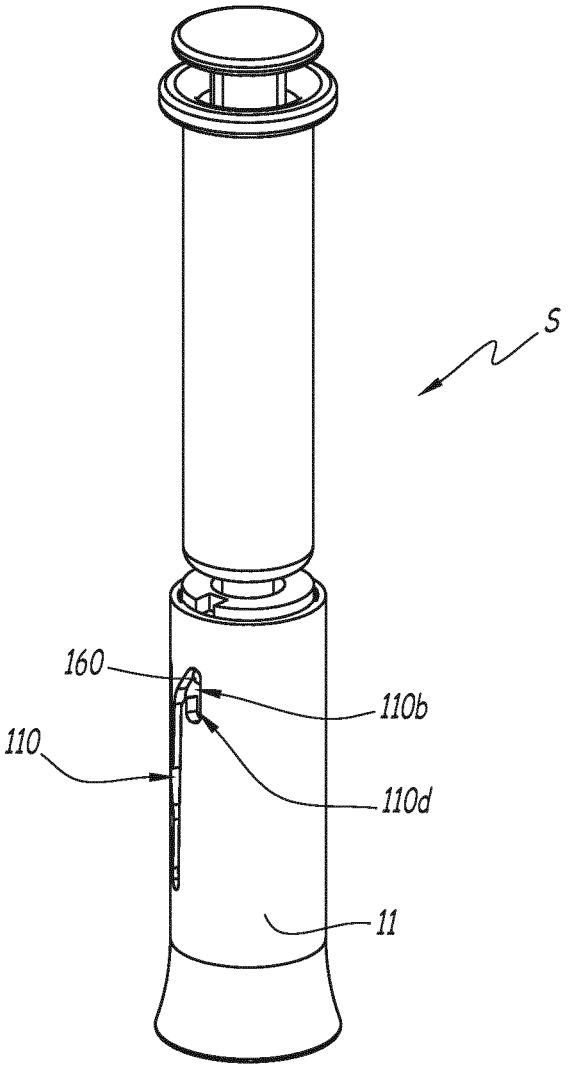
Figure 15:
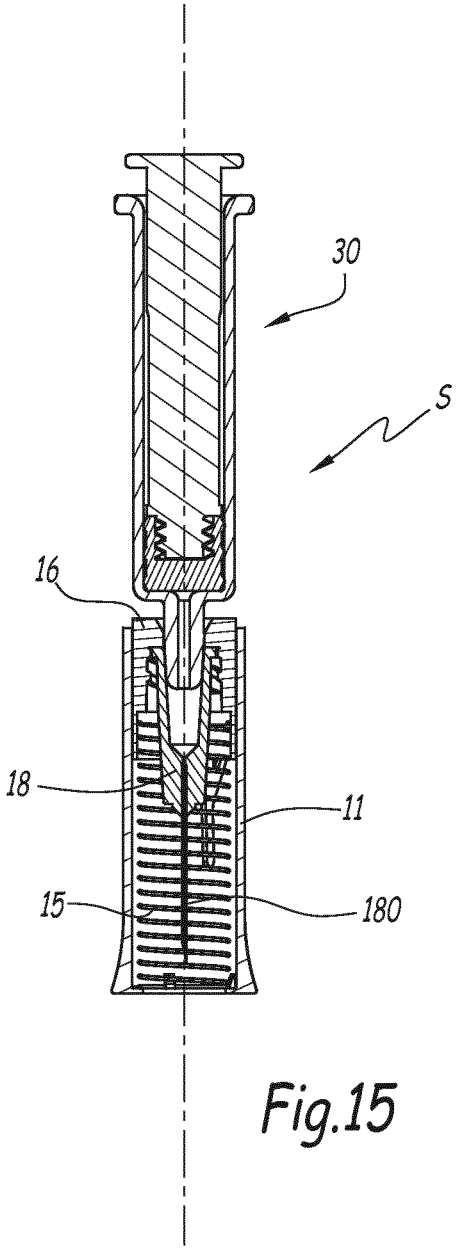
Figure 16:
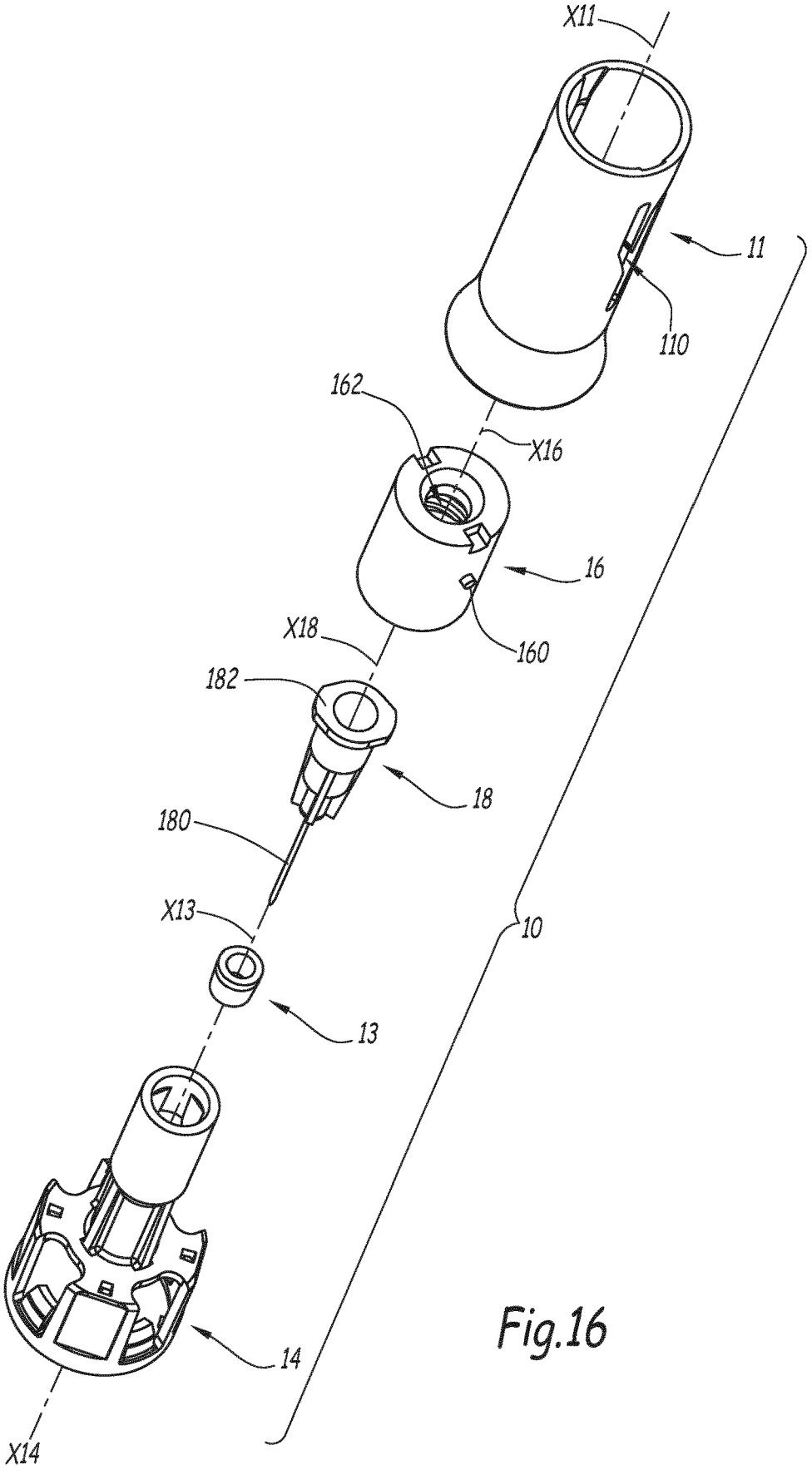
Figure 17:
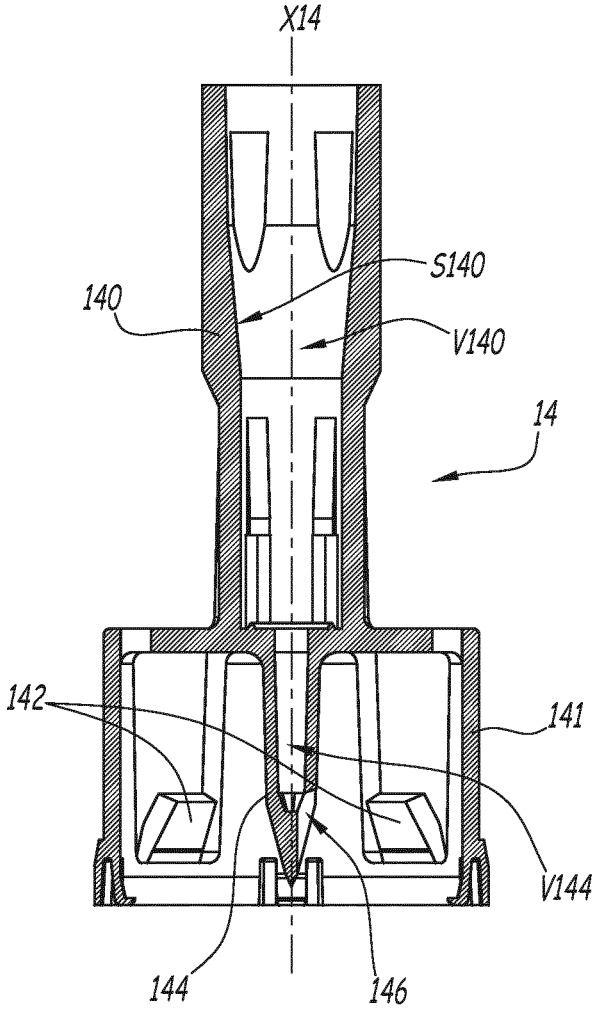
Figure 18:
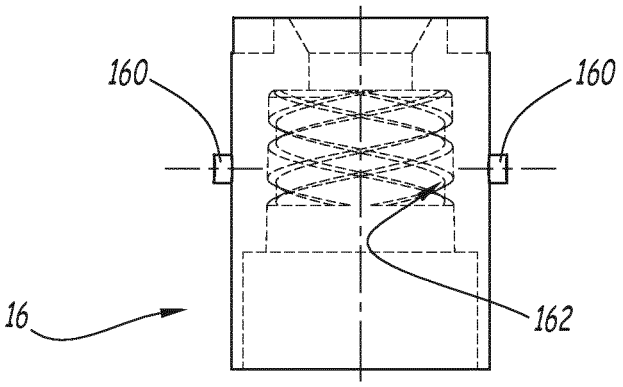

The invention and other advantages thereof will appear more clearly in light of the following description of one embodiment of a connecting device according to its principle, provided as an example and done in reference to the drawings, in which:

FIG. 1 is a perspective view showing a connecting device according to the invention and a vessel provided with a neck closed off by a perforable stopper, FIG. 2 is a sectional view in plane II of FIG. 1, FIG. 3 is an enlarged view of box III of FIG. 2, FIG. 4 is a sectional view similar to FIG. 2, in which the device is mounted on the vessel, FIG. 5 is a perspective view similar to FIG. 1, in which the connecting device is mounted on the vessel in a configuration where it is waiting to be connected with a container, in particular a syringe body, FIG. 6 is a sectional view in plane VI of FIG. 5, FIGS. 7 to 9 are sectional views similar to FIG. 6 and showing the different steps of a method for preparing an injectable solution from a drug in the form of an orodispensable tablet contained in the vessel and a solvent contained in the container, FIG. 10 is a perspective view similar to FIG. 5, in which part of the connecting assembly is detached, the detached part forming a syringe including the container, a needle holder and a safety system, FIG. 11 is a sectional view in plane XI of FIG. 10, FIG. 12 is a perspective view of the syringe of FIG. 10 in an injection configuration, FIG. 13 is a sectional view in plane XIII of FIG. 12, FIGS. 14 and 15 are figures respectively similar to FIGS. 12 and 13, in a configuration where the syringe is removed from the patient's body, i.e., after an injection, FIG. 16 is an exploded perspective view of the connecting device of FIGS. 1 to 15, FIG. 17 is a longitudinal sectional view of a base belonging to the connecting device of FIG. 16, and FIG. 18 is a front view of a collar belonging to the connecting device of FIG. 16.

FIGS. 1 to 16 show a connecting device 10 between a vessel 20 and a container 30 in different configurations. The device 10 is therefore indeed independent of the vessel 20 and the container 30. The device 10, the vessel 20 and the container 30 together form a connecting assembly 1.

The vessel 20 shown in FIGS. 1 and 2 is in particular a glass vial 22 with a geometry of revolution around an axis X22 and provided with a neck 220 closed off by a perforable stopper 26. The glass vial 22 contains an active ingredient P in the form of an orodispensable tablet or powder. The vessel 20 also comprises a plastic cap 24 that covers the stopper 26 and the neck 220 of the glass vial 22. This plastic cap 24 comprises teeth, not shown, that are anchored in the upper face of the stopper 26. Thus, the cap 24 is connected to the stopper 26. It makes sure that the stopper 26 sealably closes the neck 220 of the vial 22.

In an alternative that is not shown, the vessel 20 comprises, in place of the plastic cap 24, an aluminum ring crimped around the neck 220 of the vial 22. In this case, the resilient tabs 142 of the skirt 141 are jammed bearing against a lower face of the neck 220, which provides the fastening of the base 14 on the vessel 20. The device 10 is therefore compatible with the vessels with plastic caps, of the type of that shown in the figures, and the vessels with aluminum caps.

The container 30 shown in FIGS. 5 and 6 in particular comprises a syringe body 32 delimiting an inner volume V32 filled with a liquid solvent L. The syringe body 32 delimits an end part 320. This end part 320 delimits a flow channel for the liquid L. The body 32 has a geometry of revolution around a central axis X32. A rod 34 is translatable inside the syringe body 32 and is maintained at one of its ends inside a piston seal 36. In the example, the rod 34 is screwed inside the piston seal 36, but it may also be clipped. At the other of its ends, the rod 34 has a pushing blade 340.

As shown in FIGS. 1 and 2, the connecting device 10 is enveloped in a blister 12, which is removed after mounting of the device 10 on the vessel 20.

As shown in FIG. 17, the device 10 comprises a plastic base 14 configured to be mounted on the vessel 20. This base 14 globally has a geometry of revolution around an axis X14. The base 14 comprises a chimney 140 centered on the axis X14 and delimiting an inner radial surface S140. V140 designates the inner volume of the chimney 140.

As shown in FIG. 3, the inner radial surface S140 of the chimney 140 delimits an inner radial shoulder 140*a*. A skirt 141 extends in the lower part of the chimney 140 and is also centered on the axis X14. This skirt 141 delimits openings, in which resilient tabs 142 are provided that protrude in the inner volume of the skirt 141. These resilient tabs 142 are deformed radially outwardly during the mounting of the base 14 on the vessel 20 and then exert a radial pressing force on the plastic cap 24, which provides the cohesion between the base 14 and the vessel 20.

As shown in FIG. 17 in particular, the base 14 also includes a hollow member 144 for perforating the stopper 26. The fact that the hollow member 144 is made from plastic makes it possible to prevent coring during the perforation of the stopper 26. This hollow member 144 extends at the center of the skirt 141 and delimits three radial openings 146 distributed around the axis X14. The openings 146 place an inner volume V144 of the hollow member 144 in communication with an inner volume V22 of the vessel 20 when the base 14 is mounted on the vessel 20, i.e., when the stopper 26 is perforated. The radial shoulder 140*a* widens the inner diameter of the chimney 140 toward the hollow member 144.

An elastomeric sealing sleeve 13 is mounted inside the chimney 140, as shown in FIG. 3. More specifically, the sealing sleeve 13 defines an axis of revolution X13 and has a U-shaped section with a flat bottom. It is mounted in compression inside the chimney 140 by the end opposite the hollow member 144. When the sealing sleeve 13 is inserted, the latter is compressed radially, then regains its initial shape by resilient return when it exceeds the shoulder 140*a* delimited by the bore S140 of the chimney 140. The sealing sleeve 13 is then blocked inside the chimney 140, in a configuration where it sealably closes off the passage between the inner volume V144 of the hollow member 144 and the inner volume V140 of the chimney 140. In other words, the sleeve 13 sealably closes off the inner volume V144 of the hollow perforating member 144.

The sleeve 13 comprises a bottom wall 130 that is traversed by a metal needle 180. The needle 180 is a hypodermic needle intended to traverse the skin of the human body to inject a substance. The needle 180 includes a beveled end 180*a*, which has a height h180*a* that is greater than a height h130 of the bottom wall 130, the height h130 and the height h180*a* being measured parallel to the axis X13. Thus, there is no coring of the sleeve 13 when the needle 180 traverses its bottom wall 130.

The end 180*a* of the needle 180 emerges in the inner volume V144 of the hollow member 144. The sleeve 13 provides sealed communication between the inner volume V144 of the hollow member 144 and the central channel of the needle 180.

As shown in particular in FIG. 16, the needle 180 belongs to a needle holder 18, which is received partly inside the chimney 140. This needle holder 18 is connected detachably relative to the base 14. It is waiting to be connected with the end part 320 of the container 30. The needle holder 18 is a connector of the "luer slip" (registered trademark) type. It delimits an inner surface that is frustoconical, centered on an axis X18. More specifically, the frustoconical surface converges relative to the axis X18 toward the needle 180. The needle holder 18 delimits a through hole in which the metal hollow needle 180 is fastened. The needle holder 18 is intended to be forcibly fitted around the end part 320 of the container 30, in particular visible in FIG. 6 or 7. The connection between the needle holder 18 and the container 30 is then sealed and difficult to disassemble by traction, i.e., by pulling on the needle holder 18 in a direction opposite the container 30.

Still in reference to FIG. 16, the needle holder 18 comprises a flange 182 making it possible to attach the needle holder 18 fixedly to a collar 16. More specifically, the needle holder 18 is screwed to the inside of the collar 16, which has a tapping 162 adapted to the outer diameter of the flange 182. The collar 16 partially surrounds the chimney 140 of the base 14 and comprises two pins 160 that protrude radially outward relative to the outer radial surface of the collar 16 and which are arranged diametrically opposite. The collar 16 is centered on an axis X16.

Each pin 160 is engaged in a corresponding opening 110 of a sheath 11 arranged coaxially around the collar 16. Each opening 110 of the sheath 11 is Y-shaped, i.e., it has a first branch 110*a* and a second branch 110*b* that each extend from an axial corridor 110*c*. The sheath 11 is then connected to the collar 16 by cooperation of the pins 160 with the openings 110.

The sheath 11 has a tubular shape and defines a central axis X11, along which it is movable relative to the collar 16. The sheath 11 therefore defines two opposite orifices along the axis X11. The two orifices are substantially the same size. Advantageously, the sheath 11 is made from a rigid material, such as plastic. Unlike the resilient sealing sleeve disclosed in US-A-2014/0261877, the sheath 11 is not deformable in compression in the direction of the axis X11.

Return means 15 make it possible to keep the sheath 11 in a preliminary position, in which the sheath 11 is axially abutting against the base 14 and in which the pins 160 are at the intersection between the first branch 110*a* and the corridor 110*c* of the openings 110. The return means 15 comprise a spring inserted axially between the collar 16 and an inner radial shoulder of the sheath 11, arranged at the end.

In the assembled state of the device 10, the axes X11, X13, X18, X16 and X14 are combined with a same axis X10 of the device 10

Below, in reference to FIGS. 1 to 11, a method as described for preparing an injectable solution M from a drug in the form of an orodispensable tablet P contained in the vessel 20 and a liquid solvent L contained in the container 30. This method makes it possible to fill the container 30 with the injectable solution, i.e., with the reconstituted drug.

A first step shown in FIGS. 1 to 4 consists of removing the connection device 10 from its blister package 12, then mounting the device 10 on the vessel 20. During this step, the skirt 141 of the base 14 belonging to the device 10 surrounds the plastic cap 24 of the vessel 20. The resilient tabs 142 of the base 14 then exert a radial pressure force against the outer radial wall of the cap 24, which keeps the base 14 in contact with the vessel 20.

When the base 14 is mounted on the vessel 20, the hollow member 144 perforates the stopper 26, such that the inner volume V144 of the hollow member 144 communicates with the inner volume V22 of the vial 22 through the openings 146. In this configuration, the needle holder 18 is waiting to be connected with the end part 320 of the container 30. Furthermore, the axes X10 and X22 are combined.

Figure 7:
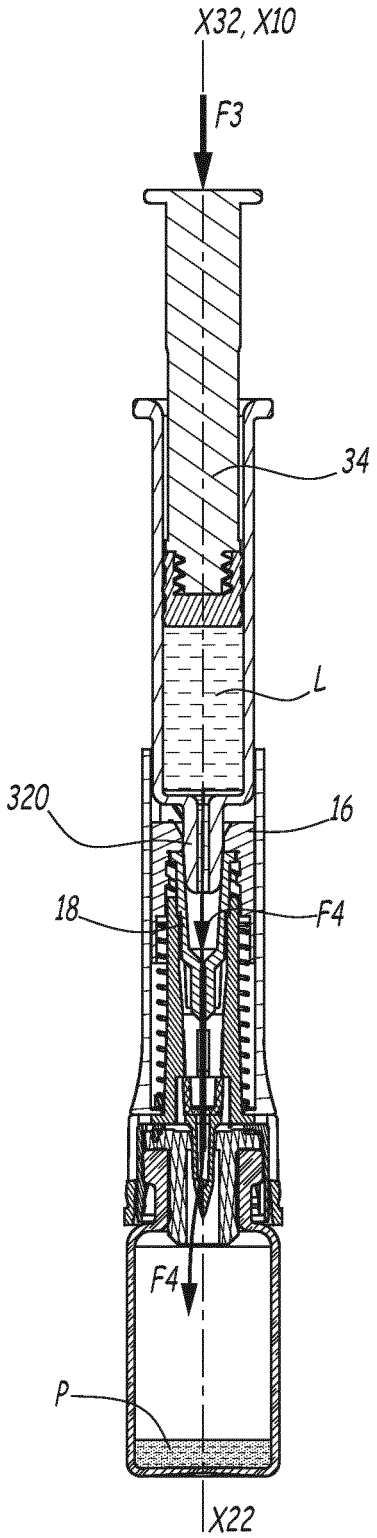

A second step shown in FIGS. 5 to 7 consists of connecting the container 30 to the device 10. During this step, the syringe body 32 is pushed inside the sheath 11 and the end part 320 of the syringe body 32 is forcibly fitted inside the needle holder 18. The needle holder 18 and the end part 320 of the syringe body 32 are then connected sealably and are difficult to disconnect by pulling. The connection assembly 1 formed by the device 10, the vessel 20 and the container 30 is then in the configuration of FIG. 7. In this configuration, the axes X10, X22 and X32 are combined. Furthermore, the metal needle 180 places the inner volume V144 of the hollow member 144 and the inner volume V32 of the syringe body 32 in communication.

A third step shown in FIGS. 7 and 8 consists of injecting the liquid solvent L inside the vessel 20. To that end, the user pushes the piston rod 34 inside the syringe body 32. In other words, he pushes on the pushing blade 340 of the rod 34 toward the vessel 20, i.e., in the direction of arrow F3 in FIG. 7, to move the piston 36 inside the syringe body 32 and thus eject the liquid solvent L contained in the inner volume V32 of the syringe body 32 toward the vessel 22. More specifically, the liquid solvent L traverses the central channel of the end part 320 of the syringe body 32, the inner volume of the needle holder 18, the central channel of the hollow needle 180, the inner volume V144 of the hollow perforating member 144 and lastly the openings 146 to reach the inner volume V22 of the vial 22. The transfer of the liquid L between the container 30 and the vessel 20 is shown by the arrows F4 in FIG. 7. The connecting assembly 1 is then in the configuration of FIG. 8, in which the drug M is reconstituted.

A fourth step shown in FIGS. 8 and 9 consists of transferring the reconstituted drug M from the vessel 20 to the container 30. To that end, the user returns the connecting assembly 1, as shown by arrow F5 in FIG. 8, optionally shakes the vessel 20 to dissolve the orodispensable tablet P well inside the solvent L and pulls the rod 34 toward the outside of the syringe body 32, i.e., in the direction of arrow F7 in FIG. 9. In the inverted configuration of FIG. 9, the reconstituted drug M flows, under the effect of the vacuum generated by the movement of the piston seal 36 inside the body 32, toward the inner volume V32 of the syringe body 32. More specifically, the drug M traverses the openings 146, the inner volume V144 of the hollow member 144 and the central channel of the hollow needle 180 to reach the inner volume of the needle holder 18, from which it can flow in the syringe body 32 through the end part 320. The transfer of the drug M from the vessel 20 to the container 30 is shown by arrow F6 in FIG. 9.

When the drug M has been completely transferred from the vessel 20 to the container 30, the user can disconnect the container 30 and the vessel 20, as shown by the arrows F8 in FIG. 10. The container 30 then brings the needle holder 18, the collar 16 in which the needle holder 18 is screwed and the protective sheath 11, which is attached to the collar 16, with it. Conversely, the base 14 remains attached to the vessel 20. Thus, the needle holder 18 is detached from the base 14. The part detached from the vessel 20 forms a ready-to-use syringe S.

After disconnection, i.e., in a configuration where the needle holder 18 is detached from the base 14, the protective sheath 11 moves from the preliminary position toward a first position under the return force exerted by the spring 15. This movement is illustrated by arrow F9 in FIG. 10. During this movement, the pins 160 then rejoin the bottom of the branch 110*a* of the openings 110. In the first position, the sheath 11 covers the needle 180, so as to avoid accidental sticking before injection and mechanically protect the needle 180 from breaking, i.e., in case the syringe S falls or in case of collision with an object. The sheath 11 and the spring 15 therefore form a safety system seeking to protect the needle 180 before an injection.

During an injection, the user presses the syringe S against the epidermis of the patient, which causes the protective sheath 11 to withdraw in contact with the skin, against the resilient force of the spring 15, from its first position toward a second position. This movement is illustrated by arrows F10 in FIG. 12. The needle 180 is then exposed and the spring 15 is compressed. Each pin 160 moves from the bottom of the first branch 110*a* toward the bottom of the corridor 110*c* of the corresponding radial opening 110. This results in rotating the sheath 11 around its axis X11, as shown by arrow R10 in FIG. 12. The user next presses on the rod 34 of the container 30 to eject the drug M into the patient's body.

When the injection is complete and the syringe S is removed from the patient's body, the protective sheath 11 moves from its second position toward its first position under the action of the spring 15. Each pin 160 then moves from the bottom of the corridor 110*c* toward the bottom of the branch 110*b* of the corresponding radial opening 110. This results in rotating the sheath 11 around its axis X11. The syringe S is then in the configuration of FIGS. 14 and 15. The sheath 11 then protects the needle 180 after the injection, so as to avoid accidental sticking and the transmission of diseases, such as HIV.

Each opening 110 is configured such that, when the sheath 11 withdraws from its first position toward its first position and returns to its first position, it pivots around the axis X11 in the counterclockwise direction when one looks at the needle 180 from the side. Thus the sheath 11, by pivoting around its axis X11, exerts a torque on the collar 16 that is oriented in the counterclockwise direction. Advantageously, this torque tends to further screw the needle holder 18 inside the collar 16. Thus, the needle holder 18 does not risk unscrewing during an injection. In other words, the sheath 11 rotates in the screwing direction of the needle holder 18.

As shown in FIGS. 14 and 15, after the injection, the sheath 11 is locked in its first position. Indeed, if one tries to withdraw the sheath 11, each pin 160 engages in a corresponding end portion 110*d* extending axially toward the corridor 110*c* and defining the free end of the branch 110*b*. This end portion 110*d* therefore forms a receiving housing of the pin 160. The axial movement of the sheath 11 is then blocked by cooperation of the pins 160 with the bottom of the housings 110*d*. Thus, a used syringe S, i.e., which has already been used, can no longer be used because it is no longer possible to expose the needle 180. The end portion 110*d* of the second branch 110*b* therefore forms locking means, configured to block the axial movement of the sheath 11 when the latter is returned to its first position, i.e., in the configuration of FIG. 15. In other words, the locking means are configured to prevent the sheath from returning toward its second position.

In the example of the figures, the preliminary position is a position midway between the first position and the second position. The sheath 11 is then shorter and narrower than if the device was arranged such that the sheath 11 would be in the first position in the configuration mounted on the vessel 20. This position at the mid-point therefore limits the bulk of the device 10 in the radial and axial directions.

In an alternative that is not shown, another system is used to connect the needle holder 18 to the syringe body 32. For example, this may be a screwed system, of the "luer lock" (registered trademark) type. This system has the advantage that the needle holder 18 is easy to disassemble.

In an alternative that is not shown, a container 30 other than a syringe body is used.

The features of the main embodiment and alternatives considered above may be combined with one another to create new embodiments of the invention.

What is claimed is:

1. A connecting device between a vessel closed off by a perforable stopper and a container, the device comprising:

a base, which is configured to be mounted on the vessel and which comprises a hollow member for perforating the stopper, this hollow member delimiting at least one opening, and a needle holder, which is detachably connected relative to the base, which is configured to be connected with the container, and which includes a hypodermic needle, one end of which emerges in the inner volume of the hollow member, wherein the device further comprises:

a collar attached to the needle holder, and a sheath, which is connected to the collar and which defines a central axis along which the sheath is movable relative to the collar and around the latter, against a resilient force exerted by a return means, and wherein the sheath cannot be deformed in compression along the central axis.

2. The device according to claim 1, wherein the return means comprise a spring inserted axially between the collar and an inner radial shoulder of the sheath.

3. The device according to claim 2, wherein the collar comprises at least one radial pin, which is engaged in a corresponding radial opening of the sheath.

4. The device according to claim 3, wherein each opening has a first branch and a second branch that each extend from an axial corridor, the first branch, the second branch and the corridor together forming a "Y".

5. The device according to claim 1, wherein the device comprises a sealing sleeve, which is traversed by the needle and which is immobilized inside the base so as to provide sealed communication between the inner volume of the hollow member and a central channel of the needle.

6. The device according to claim 5, wherein the needle has a beveled end, which has a height greater than or equal to the height of a wall of the sleeve traversed by the needle.

7. The device according to claim 1, wherein, in one configuration where the needle holder is detached from the base, the sheath is movable between a first position where it covers the needle and a second position, where the needle is exposed, and in that the return means are configured to return the sheath to its first position.

8. The device according to claim 7, wherein the device comprises means for locking the sheath in the first position, configured to prevent the sheath from returning toward its second position.

9. The device according to claim 7, wherein the needle holder is screwed inside the collar, and wherein each opening is configured such that, when the sheath is returned to its first position, it pivots around its axis in the screwing direction of the needle holder.

10. The device according to claim 1, wherein the needle holder is screwed inside the collar.

11. The device according to claim 1, wherein the sheath comprises two opposite orifices along the central axis.

12. The device according to claim 1, wherein the needle holder comprises a frustoconical inner surface to receive an end part of the container and is sized to be fitted forcibly around said end part.

13. A connecting assembly, comprising a vessel closed off by a perforable stopper, a container and a connecting device according to claim 1.

14. A method for filling a container intended to be equipped with a needle with a product contained in a vessel closed off by a perforable stopper, the method comprising:

mounting a connecting device according to claim 1 on the vessel to perforate the stopper with the perforating member, connecting the container with the needle holder, injecting a liquid present in the container into the vessel, through the central channel of the needle and the inner volume of the perforating member, arranging the vessel, the connecting device and the container in a position where the contents of the vessel flow toward the inner volume of the container, through the inner volume of the perforating member and the central channel of the needle, and disconnecting the container and the vessel, the needle holder then being removed from the base, and the sheath being moved as a whole from a preliminary position, in which the sheath is axially abutting against the base and is not axially deformed, by the return means into a first position where it covers the needle.

15. A connecting device between a vessel closed off by a perforable stopper and a container, the device comprising:

a base, which is configured to be mounted on the vessel and which comprises a hollow member for perforating the stopper, this hollow member delimiting at least one opening, and a needle holder, which is detachably connected relative to the base, which is configured to be connected with the container, and which includes a hypodermic needle, one end of which emerges in the inner volume of the hollow member, wherein the device further comprises:

a collar attached to the needle holder, and a sheath retaining the collar and defining a central axis along which the sheath and the collar are movable relative to one another against a resilient force exerted by a return means, and wherein the sheath is configured to withstand deformable compression along the central axis in response to movement of at least one of the sheath or of the collar relative to one another.

* * * * *